United States Patent [19]

Haramoto et al.

[11] 4,359,605

[45] Nov. 16, 1982

[54] MONAURAL SIGNAL TO ARTIFICIAL STEREO SIGNALS CONVERTINGS AND PROCESSING CIRCUIT FOR HEADPHONES

[75] Inventors: Yutaka Haramoto, Zama; Mitsuru Kikuchi, Kawasaki, both of Japan

[73] Assignee: Victor Company of Japan, Ltd., Yokohama, Japan

[21] Appl. No.: 208,123

[22] Filed: Nov. 13, 1980

[30] Foreign Application Priority Data

Nov. 1, 1979 [JP] Japan ..... 54-140480
Nov. 5, 1979 [JP] Japan ..... 54-142929

[51] Int. Cl.[3] ..... H04R 5/00
[52] U.S. Cl. ..... 179/1 GP; 179/1 G
[58] Field of Search ..... 179/1 G, 1 GA, 1 GP, 179/1 GQ

[56] References Cited

U.S. PATENT DOCUMENTS 3,670,106 6/1972 Orban ..... 179/1 GP
4,039,755 8/1977 Berkovitz ..... 179/1 GP
4,308,424 12/1981 Bice, Jr. ..... 179/1 GP

FOREIGN PATENT DOCUMENTS 1269187 5/1968 Fed. Rep. of Germany ... 179/1 GP
52-4802 1/1977 Japan ..... 179/1 GP

*Primary Examiner*—R. J. Hickey
*Attorney, Agent, or Firm*—Michael N. Meller; Anthony H. Handal

[57] ABSTRACT

A monaural signal to artificial stereo signals converting and processing circuit for headphones comprises, a circuit which converts a monaural signal into artificial stereo signals, a circuit which adds localizing information of imaginary sources to the artificial stereo signals thus obtained, and a circuit which adds imaginary indirect sounds to the artificial stereo signals added with the localizing information. Due to the addition of the indirect sounds, the sound expansion felt by a listener listening to a headphone expands to regions outside the listener's head.

6 Claims, 5 Drawing Figures

MONO-ARTIF STEREO CONV CKT
11
10
ADD AMP
12a
12b
DELAY CKT
13
HPF
14
15
LOCAL INF ADD CKT
16
17a
17b
18a
18b
Bi/Ai
TRANS CHARACT CKT
FREQ CHARACT CORRECT CKT
19a
19b
Ai
20a
20b
27a
27b
INDIRECT SOUND ADD CKT
21
22
23
DELAY CKT
24
CLOCK SIG GENE CKT
25a
25b
BUFF AMP
26
Br/Ar

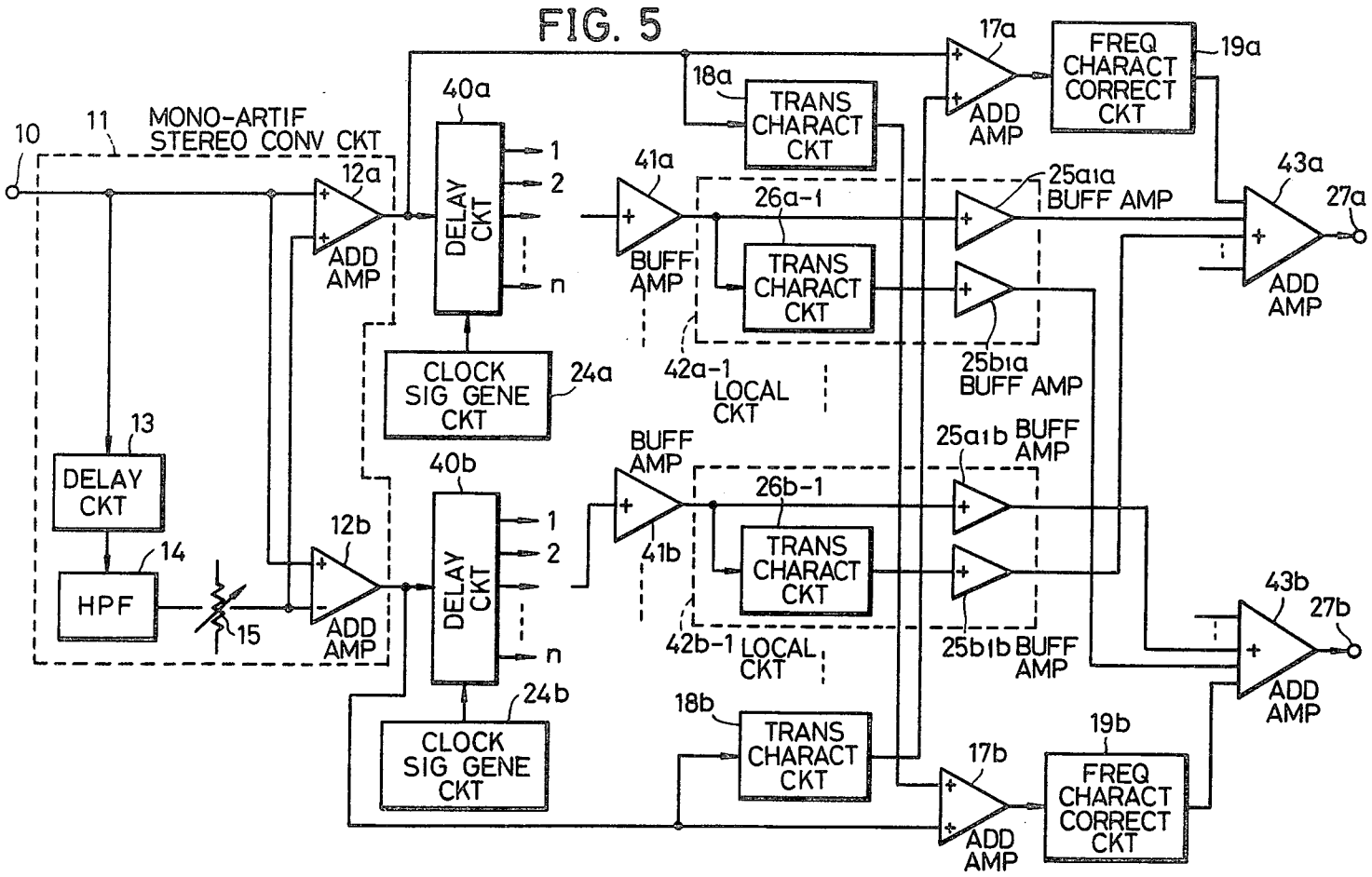
FIG. 5
MONO-ARTIF STEREO CONV CKT
11
10
12a
ADD AMP
12b
ADD AMP
13
DELAY CKT
14
HPF
15
40a
DELAY CKT
40b
DELAY CKT
1
2
n
24a
CLOCK SIG GENE CKT
24b
CLOCK SIG GENE CKT
41a
BUFF AMP
41b
BUFF AMP
42a-1
LOCAL CKT
42b-1
LOCAL CKT
26a-1
TRANS CHARACT CKT
26b-1
TRANS CHARACT CKT
18a
TRANS CHARACT CKT
18b
TRANS CHARACT CKT
17a
ADD AMP
17b
ADD AMP
19a
FREQ CHARACT CORRECT CKT
19b
FREQ CHARACT CORRECT CKT
25a1a BUFF AMP
25b1a BUFF AMP
25a1b BUFF AMP
25b1b BUFF AMP
43a
ADD AMP
43b
ADD AMP
27a
27b

MONAURAL SIGNAL TO ARTIFICIAL STEREO SIGNALS CONVERTINGS AND PROCESSING CIRCUIT FOR HEADPHONES

BACKGROUND OF THE INVENTION

The present invention relates generally to monaural signal to artificial stereo signals converting and processing circuits for headphones, and more particularly to a circuit capable of converting and processing a monaural signal into artificial stereo signals, and supplying the signal thus obtained to a headphone, so that the sound expansion felt by a listener extends into the region outside the listener's head.

Generally, so-called binaural system is known, in which microphones are provided at the positions of the two ears of a dummy-head having a shape of a human head, the sounds received at the positions of the two ears are respectively recorded, and the sounds thus recorded are reproduced and respectively supplied to both speakers of the headphone. By this system, the listener can hear these sounds as though the acoustic image were at the same position as that of the actual sound source. In order to obtain this binaural signal, the dummy head must be used.

Accordingly, a signal processing circuit has been proposed in which, a signal substantially equal to the binaural signal, electrically, is obtained from the normal monaural signal or from each of the channel signals of the stereo signals. This signal processing circuit includes two adding amplifiers, and a delay circuit. In the above circuit, the monaural signal not having localizing information is respectively applied to one of the input terminals of the two adding amplifiers. On the other hand, the monaural signal is delayed by the delay circuit and adjusted of its level by a level adjusting device. The signal thus obtained is supplied to one of the adding amplifiers so that the signal undergoes positive phase addition, and also respectively applied to the other adding amplifier so that the signal undergoes reverse phase addition. Hence, the outputs of both adding amplifiers are respectively and separately supplied to the left and right speakers of the headphone.

When the listener holds the left and right speakers respectively at his ears, to listen only from the left speaker intended for the left ear by the left ear and vice versa, the sound expansion is felt as though it extends a little outside the center from within the listener's head. Therefore, a sensation similar to that felt upon simultaneous listening of stereo signals by both ears, is obtained. However, by the conventional circuit, the sound expansion felt by the listener is, at the maximum, felt between the ears, limited within the head, and suffered a disadvantage in that satisfactory stereo effect could not be obtained.

SUMMARY OF THE INVENTION

Accordingly, it is a general object of the present invention to provide a novel and useful monaural signal to artificial stereo signals converting and processing circuit for headphones, in which the above described problems have been overcome.

Another and more specific object of the present invention is to provide a monaural signal to artificial stereo signals converting and processing circuit for headphones, comprising, a circuit for converting a monaural signal into artificial stereo signals, a circuit for adding localizing information of imaginary sound sources, and a circuit which adds indirect sounds to the artificial stereo signals added with the localizing informations. By the circuit of the present invention, not only can an artificial stereo effect be obtained together with the sound expansion by the use of a monaural signal, but a sensation in which the sound expansion expands outside the listener's head using the headphone can be obtained, since indirect sounds generated under assumption of reflections from the walls and the like is added, to give a rich presence. By increasing the number of imaginary indirect sound sources, a sensation further having richer presence and wider sound expansion can be obtained.

Other objects and further features of the present invention will be apparent from the follwing detailed description when read in conjunction with the accompanying drawings.

BRIEF DESCRIPTION OF THE DRAWINGS

FIGS. 4 and 5 are, respectively, systematic block diagrams showing a second and third embodiments of a monaural signal to artificial stereo signals converting and processing circuit of the present invention.

DETAILED DESCRIPTION

Figure 1:
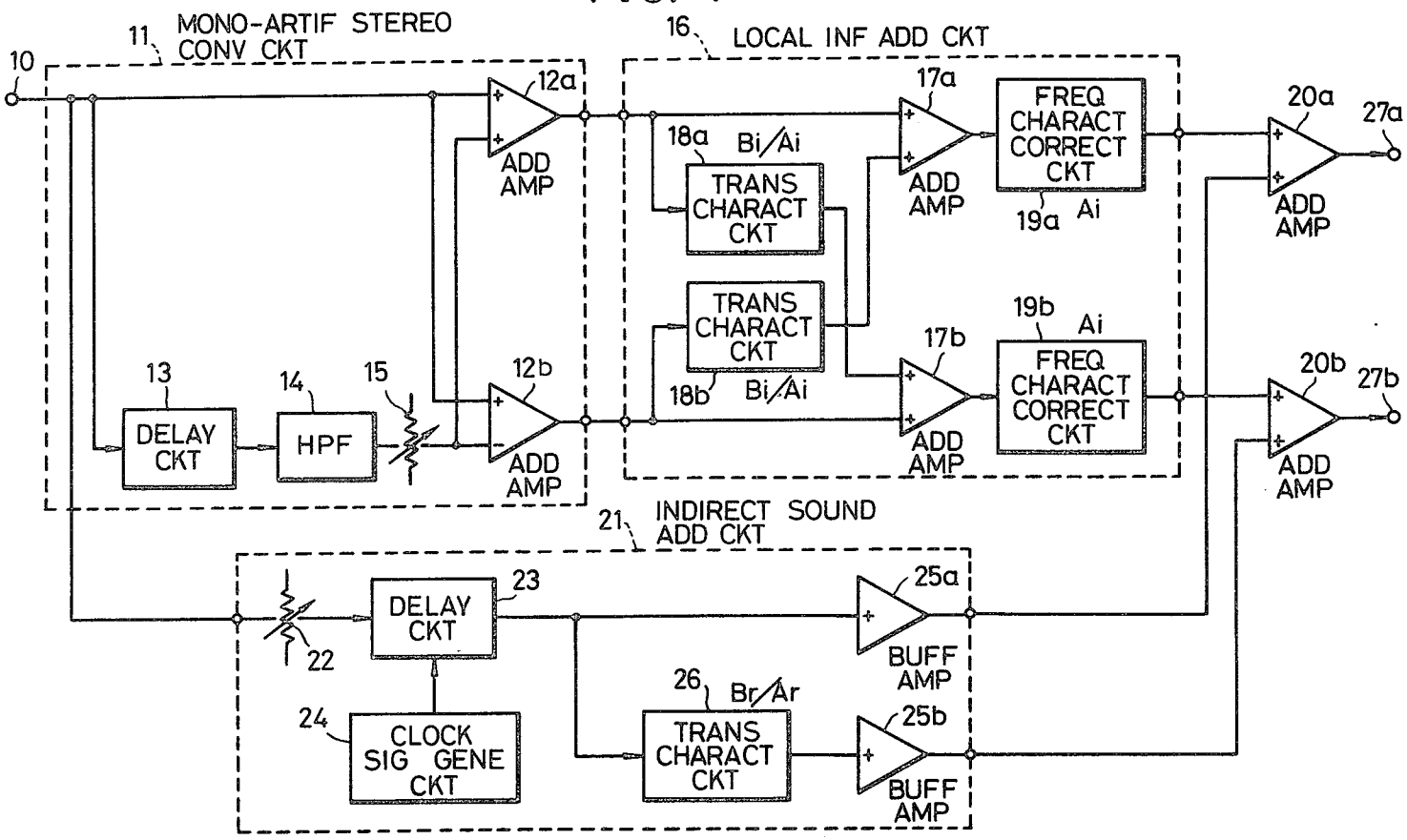
FIG. 1 is a systematic block diagram showing a first embodiment of a monaural signal to artificial stereo signals converting and processing circuit of the present invention.

In FIG. 1, a monaural signal having no localizing information is applied to an input terminal 10, and this monaural signal is supplied to adding amplifiers 12*a* and 12*b*, and also to a delay circuit 13 of a monaural-artificial stereo signal converting circuit 11. A signal delayed by the delay circuit 13 is eliminated of its low-frequency components by a high-pass filter 14. An output signal from the high-pass filter 14 is adjusted of its signal level by a level adjusting circuit 15, and supplied to the adding amplifier 12*a* so that the signal undergoes a positive phase addition and also supplied to the adding amplifier 12*b* so that it undergoes a negative phase addition. Signals thus obtained from the adding amplifiers 12*a* and 12*b* are artificial stereo signals converted from the input monaural signal. When the artificial stereo signals are supplied to a headphone and the listener listens to sounds emitted from speakers of this headphone, the sound expansion felt by the listener is merely one in which the sound expansion expands a little outside the center from within the listener's head.

Accordingly, the output signals from the converting circuit 11 are supplied to a localizing information adding circuit 16. The output signal from the adding amplifier 12*a* is supplied to an adding amplifier 17*a*, and also supplied to an adding amplifier 17*b* through a transmission characteristic circuit 18*a*. The output signal from the adding amplifier 12*b* is supplied to the adding amplifier 17*b*, and also supplied to the adding amplifier 17*a* through a transmission characteristic circuit 18*b*. Output signals of the adding amplifiers 17*a* and 17*b* are respectively supplied to adding amplifiers 20*a* and 20*b* through frequency characteristic correction circuits 19*a* and 19*b*.

Figure 2:
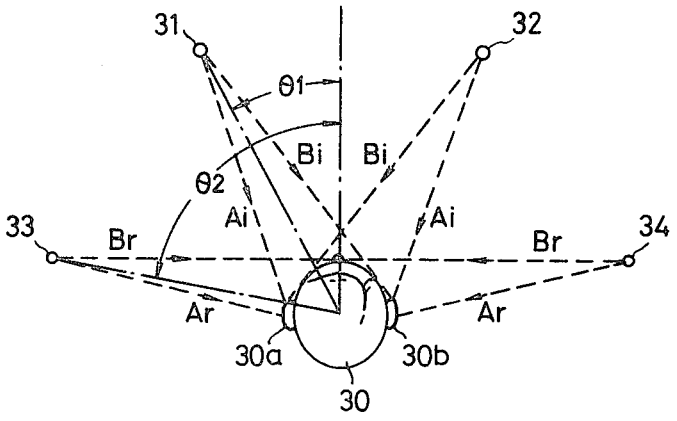
FIGS. 2 and 3 are, respectively, a graph for explaining the positions of imaginary sound sources, and a diagram showing the sound expansion of the stero effect, upon listening to sounds of the processed signals.

Next, as shown in FIG. 2, sound sources 31 and 32 are assumed to be in position having an angle $\theta_1$ as their spread angle in directions obliquely in front of a listener 30. The transmission function between the imaginary sound sources 31 and 32 and ears 30*a* and 30*b* respectively closer to the sound sources 31 and 32 is designated by $A_i$, and the transmission function between the sound sources 31 and 32 and ears respectively further away from the sound sources 31 and 32 is designated by $B_i$. The transmission characteristics of the above transmission characteristic circuits 18*a* and 18*b* are established as being characteristics of the ratio between the transmission functions $A_i$ and $B_i$, Namely, $B_i/A_i$ which is the characteristic of the distance between the ears. Accordingly, the signals passing through the transmission characteristic circuits 18*a* and 18*b* are added with a characteristic of the distance between the ears. The frequency characteristic correction circuits 19*a* and 19*b* respectively have $A_i$ as their transmission function, and correct the frequencies of the output signals from the adding amplifiers 17*a* and 17*b*.

In this manner, the artificial stereo signals from the converting circuit 11 are added with a characteristic of the difference between the ears, namely, $B_i/A_i$, at the localizing information adding circuit 16. Therefore, when the signals obtained from the frequency correction circuits 19*a* and 19*b* are supplied to the headphone, and the listener 30 listens from this headphone, the listener 30 can hear the sound as though the sound is coming from the imaginary sound sources 31 and 32 obliquely in front of the listener. Furthermore, the sound expansion felt by the listener 30 is not limited within the listener's head listening from the headphone speakers 35*a* and 35*b*, but expands to a region P outside the listener's head. Hence, a far superior stereo effect can be obtained as compared to the case when the listener listens to the output signals from the converting circuit 11 as it is.

The above described circuit construction is, for example, also shown in the U.S. Pat. No. 4,118,599.

However, upon listening without the use of a headphone, to listen from the real sound source, the reflected sounds (in-direct sounds) due to the reflections caused by the walls and the like of the room, can also be heard. Accordingly, when these indirect sounds are also considered, the above sound expansion of the stereo effect becomes one which is even more superior to that of the former.

Therefore, in the circuit of the present invention, the input signal from the input terminal 10 is supplied to an indirect sound adding circuit 21. Output signals from this indirect sound adding circuit 21 are supplied to the amplifiers 20*a* and 20*b*, and adding to the signals coming from the localizing information adding circuit 16. The input monaural signal from the input terminal 10 is adjusted of its level by a level adjusting circuit 22, and supplied to a delay circuit 23 operated by a clock signal from a clock signal generating circuit 24, in which the signal is delayed by a predetermined delay time. An output from the delay circuit 23 is supplied to the amplifier 20*a* through a buffer amplifier 25*a* on one hand, and supplied to the amplifier 20*b* through a transmission characteristic circuit 26 on the other.

Sound sources 33 and 34 of the indirect sounds due to the reflections caused by the walls and the like of the room, are assumed to be in positions at the outer sides of the imaginary sound sources 31 and 32, having spread angles $\theta_2$ ($\theta_2 > \theta_1$) in front of the listener 30. The transmission function between the indirect sound sources 33 and 34 and the ears 30*a* and 30*b* of the listener 30 respectively closer to the indirect sound sources 33 and 34 is designated by $A_r$, and the transmission function between the indirect sound sources 33 and 34 and the ears 30*a* and 30*b* of the listener 30 respectively further away from the indirect sound sources 33 and 34 is designated by $B_r$. The transmission function of the transmission characteristic circuit 26 is established as being the ratio between the transmission functions $A_r$ and $B_r$, namely, the characteristic of the distance between the ears, $B_r/A_r$.

Figure 3:
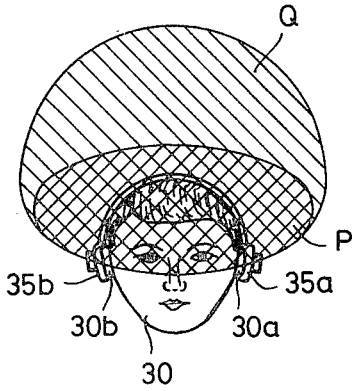

The output signals from the localizing information adding circuit 16, and the output signals from the indirect sound adding circuit 21 are added at the amplifiers 20*a* and 20*b*, and respectively obtained from output terminals 27*a* and 27*b*. When these signals obtained from the output terminals 27*a* and 27*b* are supplied to the headphone speakers 35*a* and 35*b* to be listened upon by the ears 30*a* and 30*b*, respectively, because the above signals have incorporated within the assumed indirect sound sources 33 and 34 at the outer sides of the imaginary sound sources 31 and 32, a sensation of the sound expansion having an even wider sound expansion that that obtained when the output signals from the localizing information adding circuit 16 are supplied to the headphone, can be obtained. That is, by the circuit of the present invention, as indicated by a region Q of FIG. 3, a wider sound expansion, not one which is flat like the region P, can be obtained, extending to the outer periphery above the listener's head.

Figure 4:
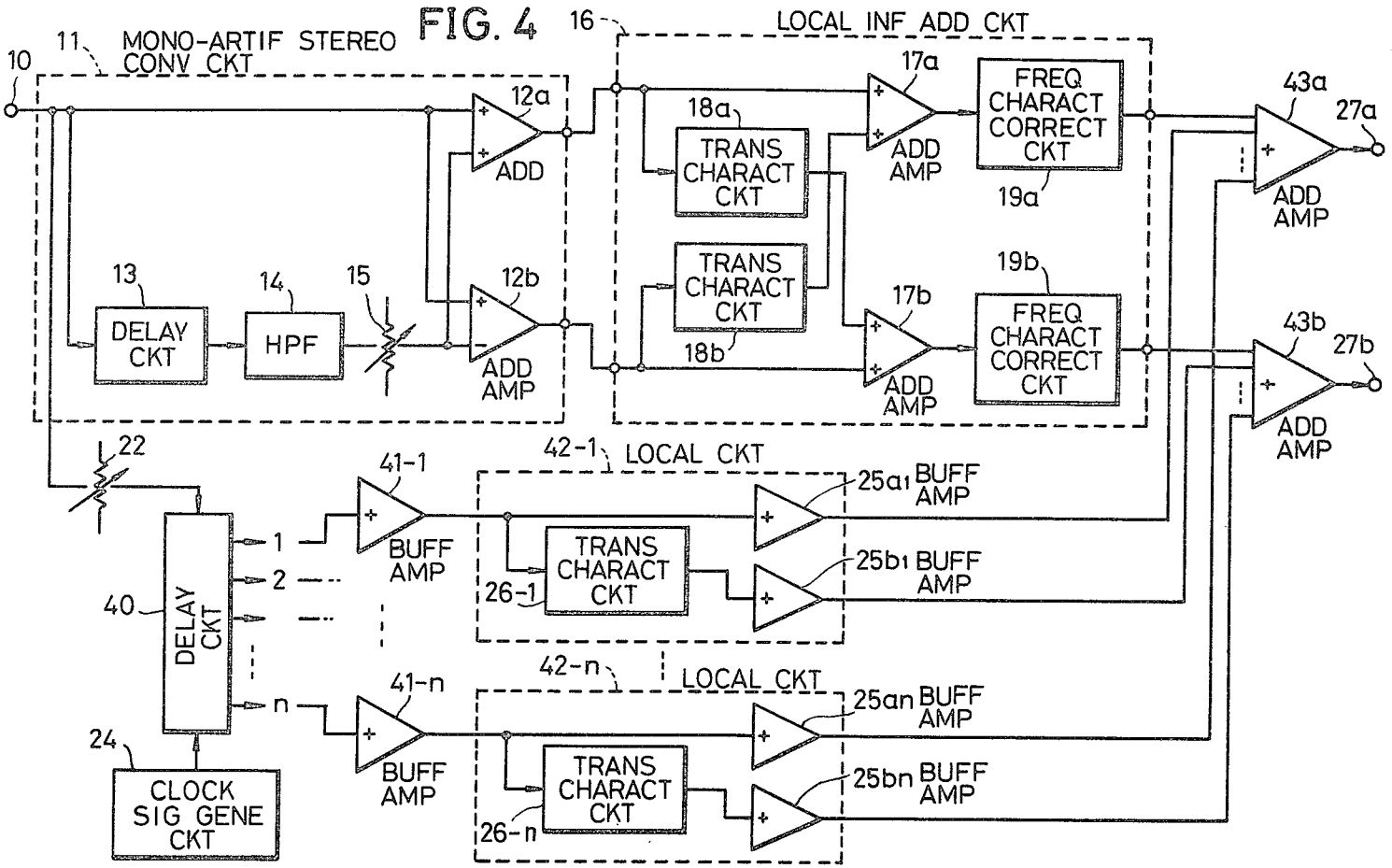

A second embodiment of a circuit of the present invention is shown in FIG. 4. In FIG. 4, those parts which are the same as those corresponding parts of FIG. 1 will be designated by the like reference numerals, and their description will be omitted. In this embodiment of the invention, indirect sound sources of the number of n (n is an integer greater than one) are assumed to be in positions at the outer or inner sides of the imaginary sound sources 31 and 32.

A delay circuit 40 which is operated by the clock signal from the lock signal generating circuit 24, has output taps of the number of n. Output signals from each of the taps of the delay circuit 40 are supplied to localizing circuits 42-1 through 42-n through buffer amplifiers 41-1 through 41-n. The localizing circuit 42-1 comprises a transmission characteristic circuit 26-1, and buffer amplifiers $25a_1$ and $25b_1$. The other localizing circuits 42-2 through 42-n are of similar construction. The output signal from the first tap of the delay circuit 40 is supplied to an adding amplifier 43*a* through the buffer amplifiers 41-1 and $25a_1$ on one hand, and supplied to an adding amplifier 43*b* through the buffer amplifier 41-1, a transmission characteristic circuit 26-1, and the buffer amplifier $25b_1$ on the other. The output signals of the other taps of the delay circuit 40 undergo similar courses.

The transmission characteristics of the transmission characteristic circuits 26-1 through 26-n are set to the ratios $B_{r1}/A_{r1}$ through $B_{rn}/A_{rn}$ which are the characteristics due to the difference of the distances between the ears, where the transmission functions $A_{r1}$ through $A_{rn}$ are the transmission functions between each of the indirect sound sources and the ear of the listener closer to the indirect sound source, and $B_{r1}$ through $B_{rn}$ are the transmission functions between each of the indirect sound sources and the ear further away from the sound source. Accordingly, in the circuit of the present embodiment, when the signals obtained from the output terminals 27*a* and 27*b* are supplied to the headphone speakers 35*a* and 35*b*, the listener experiences a sound expansion having a presence sensation richer than that obtained in the first embodiment of the invention, since a plurality of indirect sound sources are established under the assumption that they exist at both the right and left sides at the outer periphery of the above imaginary sound sources 31 and 32.

Moreover, as a modification of the embodiment of FIG. 4, switching circuits can be provided between each of the taps of the delay circuit 40 and the buffer amplifiers 41-1 through 41-n, and the delay circuit 40 and the localizing circuit corresponding to predetermined indirect sounds can be connected by connecting switching circuits in the ON state respective of the localizing circuits, to localize the indirect sounds at predetermined positions, with predetermined transmission characteristics.

A third embodiment of the circuit of the present invention is shown in FIG. 5. In FIG. 5, those parts which are the same as those corresponding parts of FIG. 4 are designated by the like reference numerals, and their description will be omitted.

Delay circuits 40*a* and 40*b* are both respectively operated by clock signals from clock signal generating circuits 24*a* and 24*b*, and respectively delay the output signals of the amplifiers 12*a* and 12*b*. The delay circuits 40*a* and 40*b* perform the delaying operations respectively having different delay values, and respectively comprise output taps of the number of n. To each of the taps of the delay circuit 40*a*, localizing circuits 42*a*-1 through 42*a-n* are connected, and to each of the taps of the delay circuit 40*b*, localizing circuits 42*b*-1 through 42*b-n* are connected. The localizing circuit 42*a*-1 comprises a transmission characteristic circuit 26*a*-1 of a transmission function $B_{ra1}/A_{ra1}$, and buffer amplifiers 25*a*1*a* and 25*b*1*a*. The localizing circuits 42*a*-2 through 42*a-n* are of similar construction. The localizing circuit 42*b*-1 comprises a transmission characteristic circuit 26*b*-1 of a transmission function $B_{rb1}/A_{rb1}$, and buffer amplifiers 25*a*1*b* and 25*b*1*b*. The other localizing circuits 42*b*-2 through 42*b-n* are of similar construction. The adding amplifier 43*a* is supplied with the output of the frequency characteristic correction circuit 19*a*, the outputs of the buffer amplifiers 25*a*1*a* through 25*ana* of the localizing circuits 42*a*-1 through 42*a-n*, and the outputs of the buffer amplifiers 25*b*1*b* through 25*bnb* of the localizing circuits 42*b*-1 through 42*b-n*, and adds these signals. The adding amplifier 43*b* is supplied with the output of the frequency characteristic correction circuit 19*b*, the outputs of the buffer amplifiers 25*b*1*a* through 25*bna* of the localizing circuits 42*a*-1 through 42*a-n*, and the outputs of the buffer amplifiers 25*a*1*b* through 25*anb* of the localizing circuits 42*b*-1 through 42*b-n*, and adds these signals.

In this embodiment of the invention, a plurality of indirect sounds are established as in the second embodiment, thus enabling the listener to experience sound expansion rich in presence sensation.

Further, this invention is not limited to these embodiments but various variations and modifications may be made without departing from the scope of the invention.

What is claimed is:

1. A signal converting and processing circuit comprising:

a converting circuit for converting a monaural signal into artificial stereo signals, said converting circuit having a delay circuit which delays an input monaural signal, an adding circuit which adds said input monaural signal and an output signal of said delay circuit, and a subtracting circuit which performs subraction between said input monaural signal and said output signal of said delay circuit, said adding circuit and subtracting circuit producing as outputs artificial stereo signals comprising a first signal and a second signal;

a localizing information adding circuit for adding localizing information of imaginary sound sources to said artificial stereo signals from said converting circuit, said localizing information adding circuit having a first and second transmission characteristic circuits comprising transmission characteristics which are respectively supplied with said first and second signals of said artificial stereo signals, a first adding circuit which adds said first signal and an output signal of said second transmission characteristic circuit, and a second adding circuit which adds said second signal and an output signal of said first transmission characteristic circuit;

an indirect sound adding circuit for adding imaginary indirect sounds to said input monaural signal, said indirect sound adding circuit having delay means for delaying said input monaural signal, a first output circuit which derives an output signal of said delay means as a first indirect sound signal, a third transmission characteristic circuit comprising a transmission characteristic supplied with said output signal from said delay means, and a second output circuit which derives on output signal from said third transmission characteristic circuit as a second indirect sound signal; and a third and fourth adding circuits which respectively add said first and second signals added with the localizing information provided by said localizing information adding circuit and said first and second indirect sound signals from said indirect sound adding circuit, said third and fourth adding circuits supplying their output signals to right and left speakers of a headphone which is fitted to a listener's ears.

2. A circuit as claimed in claim 1 in which said respective transmission function of said first and second transmission characteristic circuits are selected as being $B_iA_i$, where $A_i$ is the transmission function between an imaginary sound source and an ear closer to this source, and $B_i$ is the transmission function between the imaginary sound source and an ear further away from this source, and said transmission function of said third transmission characteristic circuit is selected as being $B_r/A_r$, where $A_r$ is the transmission function between an imaginary indirect sound source and an ear closer to this source, and $B_r$ is the transmission function between the imaginary indirect sound source and an ear further away from this source.

3. A circuit as claimed in claim 2 in which said localizing information adding circuit further comprises a first and second frequency characteristic correction circuits connected respectively to said first and second adding circuits, said first and second frequency characteristic correction circuits respectively having the transmission function $A_i$.

4. A circuit as claimed in claim 1 in which said delay means of said indirect sound adding circuit has a plurality of output terminals which generate a plurality of outputs delayed by different delay times, and said first output circuit, said third transmission characteristic circuit, and said second output circuit construct a localizing circuit, a plurality of said localizing circuits being connected respectively to each of said output terminals of said delay means.

5. A circuit as claimed in claim 4 in which said delay means comprises a clock signal generating circuit, and a delay circuit having a plurality of output terminals operated by a clock signal from said clock signal generating circuit.

6. A signal converting and processing circuit comprising;

a converting circuit for converting a monaural signal into artificial stereo signals, said converting circuit having a delay circuit which delays an input monaural signal, an adding circuit which adds said input monaural signal and an output signal of said delay circuit, and a subtracting circuit which performs subtraction between said input monaural signal and said output signal of said delay circuit, said adding circuit and subtracting circuit producing as outputs artificial stereo signals comprising a first signal and a second signal;

a localizing information adding circuit for adding localizing information of imaginary sound sources to said artificial stereo signals from said converting circuit, said localizing information adding circuit having a first and second transmission characteristic circuits comprising transmission characteristics which are respectively supplied with said first and second signals of said artificial stereo signals, a first adding circuit which adds said first signal and an output signal of said second transmission characteristic circuit, and a second adding circuit which adds said signal and an output signal of said first transmission characteristic circuit;

a first and second indirect sound adding circuits for respectively adding imaginary indirect sounds to said first and second signals, said first and second indirect sound adding circuits respectively having delay means for delaying said first and second signals, a first output circuit which derives an output signal of said delay means as a first indirect sound signal, a third transmission characteristic circuit comprising a transmission characteristic supplied with said output signal from said delay means, and a second output circuit which derives an output signal from said third transmission characteristic circuit as a second indirect sound signal; and a third and fourth adding circuits which respectively add said first and second signals added with the localizing information provided by said localizing information adding circuit and said first and second indirect sound signals from said indirect sound adding circuit, said third and fourth adding circuits supplying their output signals to left and right speakers of a headphone which is fitted to a listener's ears.

* * * * *